US009587299B2

(12) United States Patent
Maki et al.

(10) Patent No.: US 9,587,299 B2
(45) **Date of Patent: *Mar. 7, 2017**

(54) COPPER ALLOY FOR ELECTRONIC EQUIPMENT, METHOD FOR PRODUCING COPPER ALLOY FOR ELECTRONIC EQUIPMENT, ROLLED COPPER ALLOY MATERIAL FOR ELECTRONIC EQUIPMENT, AND PART FOR ELECTRONIC EQUIPMENT

(71) Applicant: MITSUBISHI MATERIALS CORPORATION, Tokyo (JP)

(72) Inventors: Kazunari Maki, Saitama (JP); Yuki Ito, Okegawa (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/349,937

(22) PCT Filed: Oct. 26, 2012

(86) PCT No.: PCT/JP2012/077736
§ 371 (c)(1),
(2) Date: Apr. 4, 2014

(87) PCT Pub. No.: WO2013/062091
PCT Pub. Date: May 2, 2013

(65) Prior Publication Data

US 2014/0283961 A1 Sep. 25, 2014

(30) Foreign Application Priority Data

Oct. 28, 2011 (JP) ..... 2011-237800

(51) Int. Cl.
*C22C 9/00* (2006.01)
*C22F 1/08* (2006.01)
(Continued)

(52) U.S. Cl.
CPC ..... *C22F 1/08* (2013.01); *C22C 9/00* (2013.01); *C22C 9/02* (2013.01); *H01B 1/026* (2013.01); *C22C 9/05* (2013.01)

(58) Field of Classification Search
CPC ..... C22F 1/08; C22C 9/00; H01B 1/026
See application file for complete search history.

(56) References Cited

U.S. PATENT DOCUMENTS 4,337,793 A * 7/1982 Sato et al. ..... 137/561 R
4,732,731 A * 3/1988 Asai et al. ..... 420/473
2006/0275618 A1 12/2006 Kugimiya et al.

FOREIGN PATENT DOCUMENTS

CN 101707084 A 5/2010
CN 102206766 A 10/2011
(Continued)

OTHER PUBLICATIONS

ASM International Handbook Committee. (1990). ASM Handbook, vol. 02—Properties and Selection: Nonferrous Alloys and Special-Purpose Materials—9. Introduction to Copper and Copper Alloys. ASM International. Online version available at: http://app.knovel.com/hotlink/pdf/id:kt007OVW5L/asm-handbook-volume-02/introduction-copper-copper, pp. 216-233.*
(Continued)

*Primary Examiner* — Roy King
*Assistant Examiner* — Jophy S Koshy
(74) *Attorney, Agent, or Firm* — Leason Ellis LLP

(57) ABSTRACT

This copper alloy for electronic devices includes Mg at a content of 3.3 at % or more and 6.9 at % or less, with a remainder substantially being Cu and unavoidable impuri-
(Continued)

ties. When a concentration of Mg is given as X at %, an electrical conductivity σ (% IACS) is in a range of $\sigma \leq \{1.7241/(-0.0347 \times X^2 + 0.6569 \times X + 1.7)\} \times 100$, and a stress relaxation rate at 150° C. after 1,000 hours is in a range of 50% or less.

12 Claims, 2 Drawing Sheets

(51) Int. Cl.

| | |
|---|---|
| ***C22C 9/02*** | (2006.01) |
| ***H01B 1/02*** | (2006.01) |
| *C22C 9/05* | (2006.01) |

(56) References Cited

FOREIGN PATENT DOCUMENTS

| | | | | | |
|---|---|---|---|---|---|
| CN | 102822363 | A | | 12/2012 | |
| DE | 3628783 | A | | 10/1987 | |
| DE | 3628783 | A1 | * | 10/1987 | ..... H01R 13/03 |
| EP | 2319947 | A | | 5/2011 | |
| JP | 63-310929 | A | | 12/1968 | |
| JP | 53-125222 | A | | 11/1978 | |
| JP | 62-250136 | A | | 10/1987 | |
| JP | 64-052034 | A | | 2/1989 | |
| JP | 01-107943 | A | | 4/1989 | |
| JP | 01-309219 | A | | 12/1989 | |
| JP | 02-111834 | A | | 4/1990 | |
| JP | 02-145737 | A | | 6/1990 | |
| JP | 03-080858 | B | | 12/1991 | |
| JP | 04-268033 | A | | 9/1992 | |
| JP | 05-082203 | A | | 4/1993 | |
| JP | 07-018354 | A | | 1/1995 | |
| JP | 07-019788 | A | | 1/1995 | |
| JP | 07018354 | A | * | 1/1995 | |
| JP | 07-166271 | A | | 6/1995 | |
| JP | 10-219372 | A | | 8/1998 | |
| JP | 11-036055 | A | | 2/1999 | |
| JP | 11-186273 | A | | 7/1999 | |
| JP | 11-199954 | A | | 7/1999 | |
| JP | 11199954 | A | * | 7/1999 | ..... C22C 9/04 |
| JP | 2001-152303 | A | | 6/2001 | |
| JP | 2011-241412 | A | | 12/2001 | |
| JP | 2002-180165 | A | | 6/2002 | |
| JP | 2005-113259 | A | | 4/2005 | |
| JP | 2010-053445 | A | | 3/2010 | |
| JP | 2010-188362 | A | | 9/2010 | |
| JP | 2011-102416 | A | | 5/2011 | |
| JP | 2012-251226 | A | | 12/2012 | |
| JP | 2013-100571 | A | | 5/2013 | |
| WO | WO-2006/000307 | A | | 1/2006 | |
| WO | WO-2011/104982 | A | | 9/2011 | |

OTHER PUBLICATIONS

Claims of copending U.S. Appl. No. 13/695,666.*
Note:—English translation of DE 3628783 A1 is included at the conclusion of the document. JP 11199954 A was cited by the appiclant in the IDS dated Apr. 4, 2014—NPL-1 was previously cited.*
English Machine Translation of JP 07018354 A (Jan. 1995).*
European Search Report mailed Jun. 6, 2014 for the related European Application No. 11780706.5.
Koya Nomura, "Technical Trends in High Performance Copper Alloy Strip for Connector and Kobe Steel's Development Strategy", *Kobe steel Engineering Reports*, vol. 54. No. 1 (2004), p. 2 to 8.
Shigenori Hori et al., "Grain Boundary Precipitation in Cu—Mg alloy", *Journal of the Japan Copper and Brass Research Association*, vol. 19, 1980, p. 115 to 124.
International Search Report mailed Jan. 29, 2013 for the corresponding PCT Application No. PCT/JP2012/077736.
International Search Report mailed Aug. 16, 2011 for the related PCT Application No. PCT/JP2011/061036.
International Search Report mailed Feb. 12, 2013 for the related PCT Application No. PCT/JP2012/078851.
International Search Report mailed Feb. 12, 2013 for the related PCT Application No. PCT/JP2012/078688.
Office Action mailed Feb. 14, 2012 for the related Japanese Application No. 2010-112265.
Office Action mailed Nov. 29, 2013 for the related Singaporean Application No. 201207897-8.
Office Action mailed Dec. 4, 2013 for the related Chinese Application No. 201180018491.7.
Written Opinion mailed Jan. 29, 2013 for the corresponding PCT Application No. PCT/JP2012/077736.
AMPCOLOY 90—Corrosion-Resistant High-Conductivity Casting Copper, *Alloy Digest*, Mar. 1981.
Office Action mailed Oct. 8, 2014 for the related U.S. Appl. No. 14/352,184.
Office Action mailed Nov. 4, 2014 for the related U.S. Appl. No. 14/353,924.
European Search Report mailed Jun. 5, 2015 for the corresponding European Application No. 12847293.3.
Murray et al., "Preparation and Characterization of Pure Metals, Properties and Selection: Nonferrous Alloys and Special-Purpose Materials", 1990, *ASM Handbook*, pp. 1093-1097, vol. 2 (print), 13 pages total (online), ASM International.
Office Action mailed Apr. 3, 2015 for the corresponding Chinese Application No. 201280047170.4.
European Search Report mailed Apr. 16, 2015 for the corresponding EP Application No. 12843355.4.
Office Action mailed Apr. 16, 2015 for the related Chinese Application No. 201280047171.9.
European Search Report mailed Apr. 16, 2015 for the related EP Application No. 12849153.7.
Office Action mailed Apr. 28, 2015 for the related U.S. Appl. No. 14/352,184.
Office Action mailed Aug. 18, 2015 for the related Japanese Application No. 2011-248731.
Office Action mailed Jan. 14, 2016 for the corresponding Taiwanese Patent Application No. 101139714.
Office Action mailed Jan. 14, 2016 for the related Taiwanese Patent Application No. 101141343.
Notice of Allowance mailed Oct. 29, 2015 for the corresponding Chinese Application No. 201280049749.4.
"ASM Specialty Handbook—Copper and its alloys", ISBN:0-87170-726-8, Aug. 2001, pp. 15.
E.G. West, "Copper and its alloys", ISBN: 0-85312-505-8, 1982, p. 129.
Summons to attend oral proceedings mailed Nov. 4, 2016 for the corresponding European Patent Application No. 12843355.4.
Summons to attend oral proceedings mailed Nov. 4, 2016 for the related European Patent Application No. 12849153.7.

* cited by examiner

COPPER ALLOY FOR ELECTRONIC EQUIPMENT, METHOD FOR PRODUCING COPPER ALLOY FOR ELECTRONIC EQUIPMENT, ROLLED COPPER ALLOY MATERIAL FOR ELECTRONIC EQUIPMENT, AND PART FOR ELECTRONIC EQUIPMENT

CROSS-REFERENCE TO RELATED PATENT APPLICATIONS

This application is a U.S. National Phase Application under 35 U.S.C. §371 of International Patent Application No. PCT/JP2012/077736, filed Oct. 26, 2012, and claims the benefit of Japanese Patent Application No. 2011-237800, filed on Oct. 28, 2011, all of which are incorporated by reference in their entirety herein. The International Application was published in Japanese on May 2, 2013 as International Publication No. WO/2013/062091 under PCT Article 21(2).

FIELD OF THE INVENTION

The present invention relates to a copper alloy for an electronic equipment (electronic devices) which is appropriate for a part for an electronic equipment (electronic devices) such as a terminal, a connector, a relay, and a lead frame, a method for producing a copper alloy for an electronic equipment (electronic devices), a rolled copper alloy material for an electronic equipment (electronic devices), and a part for an electronic equipment (electronic devices).

BACKGROUND OF THE INVENTION

In the related art, due to a reduction in the size of an electronic device or an electric device, reductions in the size and the thickness of a part for electronic devices such as a terminal, a connector, a relay, and a lead frame used in the electronic equipment, the electric device, or the like have been achieved. Therefore, as a material of the part for electronic devices, a copper alloy having excellent spring property, strength, and electrical conductivity has been required. Particularly, as disclosed in Non-Patent Document 1, it is desirable that the copper alloy used in the part for electronic devices such as a terminal, a connector, a relay, and a lead frame has high proof stress and low Young's modulus.

Here, as the copper alloy used in the part for electronic devices such as a terminal, a connector, a relay, and a lead, for example, as disclosed in Patent Document 1, phosphor bronze containing Sn and P has been widely used.

In addition, for example, in Patent Document 2, a Cu—Ni—Si-based alloy (so-called Corson alloy) is provided. The Corson alloy is a precipitation hardening type alloy in which $Ni_2Si$ precipitates are dispersed, and has relatively high electrical conductivity, strength, and stress relaxation resistance. Therefore, the Corson alloy has been widely used in a terminal for a vehicle and a small terminal for signal, and has been actively developed in recent years.

In addition, as the other alloys, a Cu—Mg alloy described in Non-Patent Document 2, a Cu—Mg—Zn—B alloy described in Patent Document 3, and the like have been developed.

PRIOR ART DOCUMENTS

Patent Documents

Patent Document 1: Japanese Unexamined Patent Application, First Publication No. H01-107943

Patent Document 2: Japanese Unexamined Patent Application, First Publication No. H11-036055

Patent Document 3: Japanese Unexamined Patent Application, First Publication No. H07-018354

Non-Patent Document

Non-Patent Document 1: Koya Nomura, "Technical Trends in High Performance Copper Alloy Strip for Connector and Kobe Steel's Development Strategy", Kobe Steel Engineering Reports Vol. 54, No. 1 (2004), p. 2 to 8

Non-Patent Document 2: Shigenori Hori and two co-researchers, "Intergranular (Grain Boundary) Precipitation in Cu—Mg Alloy", Journal of the Japan Copper and Brass Research Association, Vol. 19 (1980), p. 115 to 124

Problems to be Solved by the Invention

However, the phosphor bronze described in Patent Document 1 has tendency to increase a stress relaxation rate at a high temperature. Here, in a connecter having a structure in which a male tab is inserted by pushing up a spring contact portion of a female, when the stress relaxation rate is high at a high temperature, contact pressure during use in a high temperature environment is reduced, and there is concern that electrical conduction failure may occur. Therefore, the phosphor bronze cannot be used in a high temperature environment such as the vicinity of a vehicle engine room.

In addition, the Corson alloy disclosed in Patent Document 2 has a Young's modulus of 125 to 135 GPa, which is relatively high. Here, in the connecter having the structure in which the male tab is inserted by pushing up the spring contact portion of the female, when the Young's modulus of the material of the connector is high, the contact pressure fluctuates during the insertion, the contact pressure easily exceeds the elastic limit, and there is concern for plastic deformation, which is not preferable.

Furthermore, in the Cu—Mg based alloy disclosed in Non-Patent Document 2 and Patent Document 3, an intermetallic compound precipitates as is the case with the Corson alloy, and the Young's modulus tends to be high. Therefore, as described above, the Cu—Mg based alloy is not preferable as the connector.

Moreover, in the Cu—Mg based alloy, many coarse intermetallic compounds are dispersed in a matrix phase, and thus cracking is likely to occur from the intermetallic compounds as the start points during bending. Therefore, there is a problem in that a part for electronic devices having a complex shape cannot be formed.

The present invention has been made taking the foregoing circumstances into consideration, and an object thereof is to provide a copper alloy for electronic devices which has low Young's modulus, high proof stress, high electrical conductivity, excellent stress relaxation resistance, and excellent bending formability and thus is appropriate for a part for electronic devices such as a terminal, a connector, a relay, and a lead frame, a method for producing a copper alloy for electronic devices, a rolled copper alloy material for electronic devices, and a part for electronic devices.

SUMMARY OF THE INVENTION

Means for Solving the Problems

In order to solve the problems, the inventors had intensively researched, and as a result, they had learned that a work hardening type copper alloy of a Cu—Mg solid solution alloy supersaturated with Mg produced by solutionizing a Cu—Mg alloy and performing rapid cooling thereon exhibits low Young's modulus, high proof stress, high electrical conductivity, and excellent bending formability. In addition, it was found that the stress relaxation resistance can be enhanced by performing an appropriate heat treatment on the copper alloy made from the Cu—Mg solid solution alloy supersaturated with Mg after finishing working.

The present invention has been made based on the above-described knowledge, and a copper alloy for electronic devices according to the present invention consists of a binary alloy of Cu and Mg containing Mg at a content of 3.3 at % or more and 6.9 at % or less, with a remainder substantially being Cu and unavoidable impurities, wherein, when a concentration of Mg is given as X at %, an electrical conductivity σ (% IACS) is in a range of $\sigma \leq \{1.7241/(-0.0347 \times X^2+0.6569 \times X+1.7)\} \times 100$, and a stress relaxation rate at 150° C. after 1,000 hours is in a range of 50% or less.

In addition, a copper alloy for electronic devices according to the present invention consists of a binary alloy of Cu and Mg containing Mg at a content of 3.3 at % or more and 6.9 at % or less, with a remainder substantially being Cu and unavoidable impurities, wherein an average number of intermetallic compounds mainly containing Cu and Mg and having grain sizes of 0.1 μm or greater is in a range of 1 piece/$\mu m^2$ or less during observation by a scanning electron microscope, and a stress relaxation rate at 150° C. after 1,000 hours is in a range of 50% or less.

Moreover, a copper alloy for electronic devices according to the present invention consists of a binary alloy of Cu and Mg containing Mg at a content of 3.3 at % or more and 6.9 at % or less, with a remainder substantially being Cu and unavoidable impurities, wherein, when a concentration of Mg is given as X at %, an electrical conductivity σ (% IACS) is in a range of $\sigma \leq 1.7241/(-0.0347 \times X^2+0.6569 \times X+1.7) \times 100$, an average number of intermetallic compounds mainly containing Cu and Mg and having grain sizes of 0.1 μm or greater is in a range of 1 piece/$\mu m^2$ or less during observation by a scanning electron microscope, and a stress relaxation rate at 150° C. after 1,000 hours is in a range of 50% or less.

In the copper alloy for electronic devices having the above configuration, Mg is contained at a content of 3.3 at % or more and 6.9 at % or less so as to be equal to or more than a solid solubility limit, and the electrical conductivity σ is set to be in the range of the above expression when the Mg content is given as X at %. Therefore, the copper alloy is the Cu—Mg solid solution alloy supersaturated with Mg.

Otherwise, Mg is contained at a content of 3.3 at % or more and 6.9 at % or less so as to be equal to or more than a solid solubility limit, and the average number of intermetallic compounds mainly containing Cu and Mg and having grain sizes of 0.1 μm or greater is in a range of 1 piece/$\mu m^2$ or less during observation by a scanning electron microscope. Therefore, the precipitation of the intermetallic compounds mainly containing Cu and Mg is suppressed, and the copper alloy is the Cu—Mg solid solution alloy supersaturated with Mg.

In addition, the average number of intermetallic compounds mainly containing Cu and Mg and having grain sizes of 0.1 μm or greater is calculated by observing 10 visual fields at a 50,000-fold magnification in a visual field of about 4.8 $\mu m^2$ using a field emission type scanning electron microscope.

In addition, the grain size of the intermetallic compound mainly containing Cu and Mg is the average value of a major axis of the intermetallic compound (the length of the longest intragranular straight line which is drawn under a condition without intergranular contact on the way) and a minor axis (the length of the longest straight line which is drawn under a condition without intergranular contact on the way in a direction perpendicular to the major axis).

The copper alloy made from the Cu—Mg solid solution alloy supersaturated with Mg has tendency to decrease the Young's modulus, and for example, even when the copper alloy is applied to a connector in which a male tab is inserted by pushing up a spring contact portion of a female or the like, a change in contact pressure during the insertion is suppressed, and due to a wide elastic limit, there is no concern for plastic deformation easily occurring. Therefore, the copper alloy is particularly appropriate for a part for electronic devices such as a terminal, a connector, a relay, and a lead frame.

In addition, since the copper alloy is supersaturated with Mg, coarse intermetallic compounds mainly containing Cu and Mg, which are the start points of cracks, are not largely dispersed in the matrix, and bending formability is enhanced. Therefore, a part for electronic devices having a complex shape such as a terminal, a connector, a relay, and a lead frame can be formed.

Moreover, since the copper alloy is supersaturated with Mg, strength can be increased by work hardening.

In addition, in the copper alloy for electronic devices according to the present invention, since the stress relaxation rate at 150° C. after 1,000 hours is in a range of 50% or less, even when the copper alloy is used under a high temperature environment, electrical conduction failure due to a reduction in contact pressure can be suppressed. Therefore, the copper alloy can be applied as the material of a part for electronic devices used under the high temperature environment such as an engine room.

Furthermore, in the copper alloy for electronic devices described above, it is preferable that a Young's modulus E be in a range of 125 GPa or less and a 0.2% proof stress $\sigma_{0.2}$ be in a range of 400 MPa or more.

In the case where Young's modulus E is in a range of 125 GPa or less and the 0.2% proof stress $\sigma_{0.2}$ is in a range of 400 MPa or more, the elastic energy coefficient ($\sigma_{0.2}{}^2/2E$) is increased, and thus plastic deformation does not easily occur. Therefore, the copper alloy is particularly appropriate for a part for electronic devices such as a terminal, a connector, a relay, and a lead frame.

A method for producing an copper alloy for electronic devices according to the present invention, is a method for producing the copper alloy for electronic devices described above, and includes: a finishing working process of subjecting a copper material, which consists of a binary alloy of Cu and Mg and has a composition that contains Mg at a content of 3.3 at % or more and 6.9 at % or less, with a remainder substantially being Cu and unavoidable impurities, to working into a predetermined shape; and a finishing heat treatment process of performing a heat treatment after the finishing working process.

According to the method for producing an copper alloy for electronic devices having the configuration described above, since the finishing working process of working the copper material having the above-described composition into the predetermined shape and the finishing heat treatment process of performing the heat treatment after the finishing working process are included, the stress relaxation resistance can be enhanced by the finishing heat treatment process.

Here, in the finishing heat treatment process, it is preferable that the heat treatment be performed at a temperature of higher than 200° C. and 800° C. or lower. Moreover, it is preferable that the heated copper material be cooled to a temperature of 200° C. or lower at a cooling rate of 200° C./min or higher.

In this case, the stress relaxation resistance can be enhanced by the finishing heat treatment process, and the stress relaxation rate at 150° C. after 1,000 hours can be in a range of 50% or less.

A rolled copper alloy material for electronic devices according to the present invention consists of the copper alloy for electronic devices described above, a Young's modulus E in a direction parallel to a rolling direction is in a range of 125 GPa or less, and a 0.2% proof stress $\sigma_{0.2}$ in the direction parallel to the rolling direction is in a range of 400 MPa or more.

According to the rolled copper alloy material for electronic devices having this configuration, the elastic energy coefficient ($\sigma_{0.2}^2/2E$) is high, and plastic deformation does not easily occur.

In addition, it is preferable that the rolled copper alloy material for electronic devices described above be used as a copper material included in a terminal, a connector, a relay, and a lead frame.

Furthermore, a part for electronic devices according to the present invention includes the copper alloy for electronic devices described above. The part for electronic devices having this configuration (for example, a terminal, a connector, a relay, and a lead frame) has low Young's modulus and excellent stress relaxation resistance, and thus can be used even under a high temperature environment.

Effects of the Invention

According to the present invention, the copper alloy for electronic devices which has low Young's modulus, high proof stress, high electrical conductivity, excellent stress relaxation resistance, and excellent bending formability and is appropriate for a part for electronic devices such as a terminal, a connector, or a relay, the method for producing a copper alloy for electronic devices, the rolled copper alloy material for electronic devices, and the part for electronic devices can be provided.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
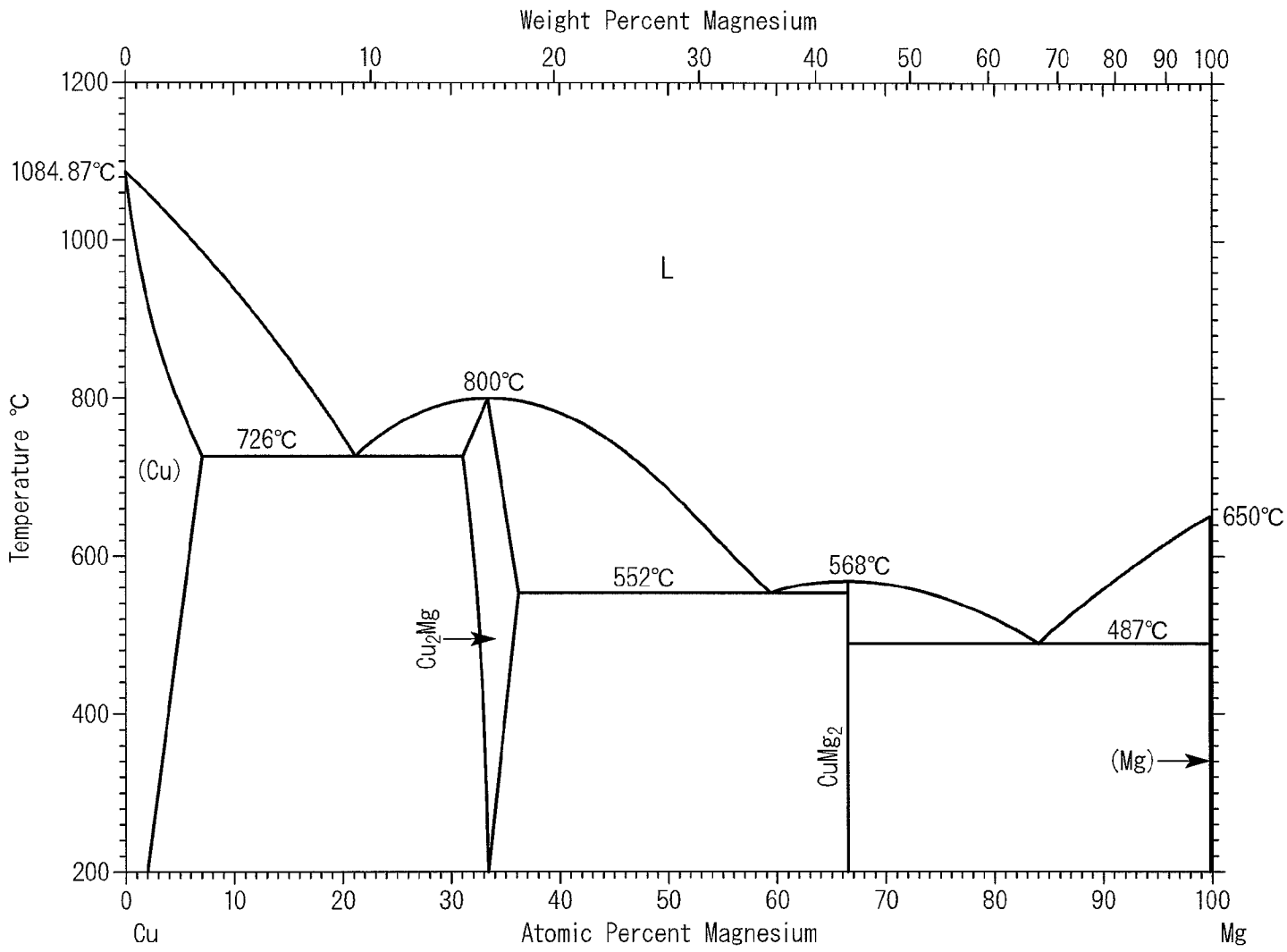
FIG. 1 is a Cu—Mg system phase diagram.

Hereinafter, a copper alloy for electronic devices according to an embodiment of the present invention will be described.

The copper alloy for electronic devices according to this embodiment is a binary alloy of Cu and Mg, which contains Mg at a content of 3.3 at % or more and 6.9 at % or less, with a remainder being Cu and unavoidable impurities.

In addition, when the Mg content is given as X at %, the electrical conductivity a (% IACS) is in a range of $\sigma \leq \{1.7241/(-0.0347 \times X^2+0.6569 \times X+1.7)\} \times 100$.

In addition, during observation by a scanning electron microscope, the average number of intermetallic compounds mainly containing Cu and Mg and having grain sizes of 0.1 μm or greater is in a range of 1 piece/$\mu m^2$ or less.

In addition, the stress relaxation rate of the copper alloy for electronic devices according to this embodiment at 150° C. after 1,000 hours is in a range of 50% or less. Here, the stress relaxation rate was measured by applying stress using a method based on a cantilevered screw type of JCBA-T309: 2004 of The Japan Copper and Brass Association Technical Standards.

In addition, the copper alloy for electronic devices has a Young's modulus E of 125 GPa or less and a 0.2% proof stress $\sigma_{0.2}$ of 400 MPa or more.

(Composition)

Mg is an element having an operational effect of increasing strength and increasing recrystallization temperature without greatly reduction in electrical conductivity. In addition, by solid-solubilizing Mg in a matrix phase, Young's modulus is suppressed to be low and excellent bending formability can be obtained.

Here, when the Mg content is in a range of less than 3.3 at %, the operational effect thereof cannot be achieved. In contrast, when the Mg content is in a range of more than 6.9 at %, intermetallic compounds mainly containing Cu and Mg remain in a case where a heat treatment is performed for solutionizing, and thus there is concern that cracking may occur in subsequent works.

For this reason, the Mg content is set to be in a range of 3.3 at % or more and 6.9 at % or less.

Moreover, when the Mg content is low, strength is not sufficiently increased, and Young's modulus cannot be suppressed to be sufficiently low. In addition, since Mg is an active element, when Mg is excessively added, there is concern that an Mg oxide generated by a reaction between Mg and oxygen may be incorporated during melting and casting. Therefore, it is more preferable that the Mg content be in a range of 3.7 at % or more and 6.3 at % or less.

In addition, examples of the unavoidable impurities include Sn, Zn, Al, Ni, Cr, Zr, Fe, Co, Ag, Mn, B, P, Ca, Sr, Ba, Sc, Y, a rare earth element, Hf, V, Nb, Ta, Mo, W, Re, Ru, Os, Se, Te, Rh, Ir, Pd, Pt, Au, Cd, Ga, In, Li, Si, Ge, As, Sb, Ti, Tl, Pb, Bi, S, O, C, Be, N, H, and Hg. The total amount of unavoidable impurities in the binary alloy of Cu and Mg is desirably in a range of 0.3 mass % or less in terms of the total amount. Particularly, it is preferable that the amount of Sn be in a range of less than 0.1 mass %, and the amount of Zn be in a range of less than 0.01 mass %. This is because when 0.1 mass % or more of Sn is added, precipitation of the intermetallic compounds mainly containing Cu and Mg is likely to occur, when 0.01 mass % or more of Zn is added, fumes are generated in a melting and casting process and adhere to members such as a furnace or a mold, resulting in the deterioration of the surface quality of an ingot and the deterioration of stress corrosion cracking resistance.

(Electrical Conductivity σ)

When the Mg content is given as X at %, in a case where the electrical conductivity σ is in a range of $\sigma \leq \{1.7241/(-0.0347 \times X^2+0.6569 \times X+1.7)\} \times 100$ in the binary alloy of Cu and Mg, the intermetallic compounds mainly containing Cu and Mg are rarely present.

That is, in a case where the electrical conductivity σ is higher than that of the above expression, a large amount of the intermetallic compounds mainly containing Cu and Mg are present and the size thereof is relatively large, and thus bending formability greatly deteriorates. In addition, since the intermetallic compounds mainly containing Cu and Mg are formed and the amount of solid-solubilized Mg is small, the Young's modulus is also increased. Therefore, production conditions are adjusted so that the electrical conductivity σ is in the range of the above expression.

In addition, in order to reliably achieve the operational effect, it is preferable that the electrical conductivity a (% IACS) be in a range of $\sigma \leq \{1.7241/(-0.0300 \times X^2+0.6763 \times X+1.7)\} \times 100$. In this case, a smaller amount of the intermetallic compounds mainly containing Cu and Mg is contained, and thus bending formability is further enhanced.

In order to further reliably achieve the operational effect, the electrical conductivity a (% IACS) is more preferably in a range of $\sigma \leq \{1.7241/(-0.0292 \times X^2+0.6797 \times X+1.7)\} \times 100$. In this case, since a further smaller amount of the intermetallic compounds mainly containing Cu and Mg is contained, bending formability is further enhanced.

(Stress Relaxation Rate)

In the copper alloy for electronic devices according to this embodiment, as described above, the stress relaxation rate at 150° C. after 1,000 hours is in a range of 50% or less. In a case where the stress relaxation rate under this condition is low, even when the copper alloy is used under a high temperature environment, permanent deformation can be suppressed to be small, and a reduction in contact pressure can be suppressed. Therefore, the copper alloy for electronic devices according to this embodiment can be applied as a terminal used under a high temperature environment such as the vicinity of a vehicle engine room.

In addition, the stress relaxation rate at 150° C. after 1,000 hours is preferably in a range of 30% or less, and more preferably in a range of 20% or less.

(Structure)

In the copper alloy for electronic devices according to this embodiment, as a result of the observation by the scanning electron microscope, the average number of intermetallic compounds mainly containing Cu and Mg and having grain sizes of 0.1 μm or greater is in a range of 1 piece/$\mu m^2$ or less. That is, the intermetallic compounds mainly containing Cu and Mg rarely precipitate, and Mg is solid-solubilized in the matrix phase.

Here, when solutionizing is incomplete or the intermetallic compounds mainly containing Cu and Mg precipitate after the solutionizing and thus a large amount of the intermetallic compounds having large sizes are present, the intermetallic compounds becomes the start points of cracks, and cracking occurs during working or bending formability greatly deteriorates. In addition, when the amount of the intermetallic compounds mainly containing Cu and Mg is large, the Young's modulus is increased, which is not preferable.

As a result of the observation of the structure, in a case where the intermetallic compounds mainly containing Cu and Mg and having grain sizes of 0.1 μm or greater is in a range of 1 piece/$\mu m^2$ or less in the alloy, that is, in a case where the intermetallic compounds mainly containing Cu and Mg are absent or account for a small amount, good bending formability and low Young's modulus can be obtained.

Furthermore, in order to reliably achieve the operational effect described above, it is more preferable that the number of intermetallic compounds mainly containing Cu and Mg and having grain sizes of 0.05 μm or greater in the alloy be in a range of 1 piece/$\mu m^2$ or less. In addition, the upper limit of the grain size of the intermetallic compound generated in the copper alloy of the present invention is preferably 5 μm, and is more preferably 1 μm.

In addition, the average number of intermetallic compounds mainly containing Cu and Mg is obtained by observing 10 visual fields at a 50,000-fold magnification and a visual field of about 4.8 $\mu m^2$ using a field emission type scanning electron microscope and calculating the average value thereof.

In addition, the grain size of the intermetallic compound mainly containing Cu and Mg is the average value of a major axis of the intermetallic compound (the length of the longest intragranular straight line which is drawn under a condition without intergranular contact on the way) and a minor axis (the length of the longest straight line which is drawn under a condition without intergranular contact on the way in a direction perpendicular to the major axis).

(Grain Size)

Grain size is a factor which greatly affects stress relaxation resistance, and stress relaxation resistance deteriorates in a case where the grain size is smaller than a necessary value. In addition, in a case where the grain size is larger than a necessary value, bending formability is adversely affected. Therefore, it is preferable that the average grain size be in a range of 1 μm or greater and 100 μm or smaller. In addition, the average grain size is more preferably in a range of 2 μm or greater and 50 μm or smaller, and even more preferably in a range of 5 μm or greater and 30 μm or smaller.

In addition, in a case where a working ratio in a finishing working process S06, which will be described later, is high, the structure becomes a worked structure, and thus the grain size may not be measured. Therefore, it is preferable that the average grain size in steps before the finishing working process S06 (after an intermediate heat treatment process S05) be in the above-described range.

Figure 2:
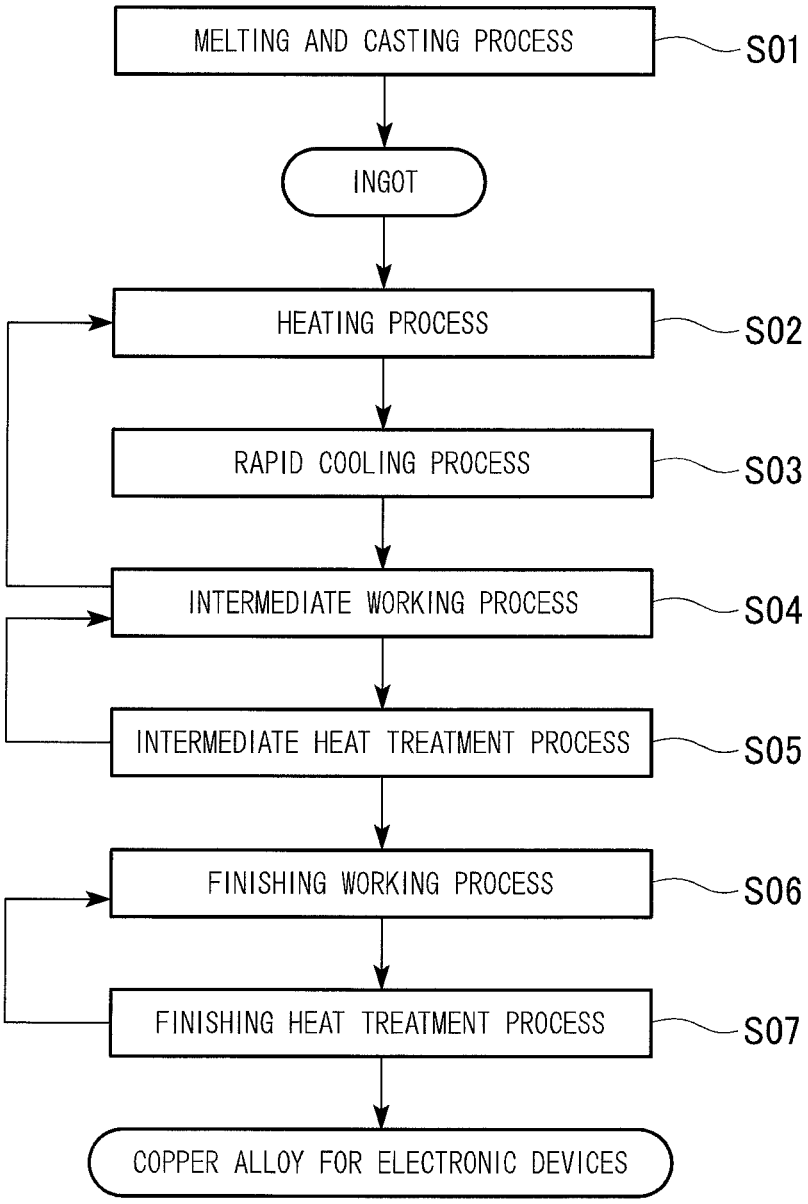
FIG. 2 is a flowchart of a method for producing a copper alloy for electronic devices according to an embodiment.

Next, a method for producing the copper alloy for electronic devices having the configuration according to this embodiment will be described with reference to a flowchart illustrated in FIG. 2.

In addition, in the production method described as follows, in a case where rolling is used as a working process, the working ratio corresponds to a rolling ratio.

(Melting and Casting Process S01)

First, the above-described elements are added to molten copper obtained by melting a copper raw material for component adjustment, thereby producing a molten copper alloy. Furthermore, for the addition of Mg, a single element of Mg, a Cu—Mg base alloy, or the like may be used. In addition, a raw material containing Mg may be melted together with the copper raw material. In addition, a recycled material and a scrap material of this alloy may be used.

Here, the molten copper is preferably a so-called 4NCu having a purity of 99.99 mass % or higher. In addition, in the meting process, in order to suppress the oxidation of Mg, a vacuum furnace or an atmosphere furnace in an inert gas atmosphere or in a reducing atmosphere is preferably used.

In addition, the molten copper alloy which is subjected to the component adjustment is poured into a mold, thereby producing the ingot. In addition, considering mass production, a continuous casting method or a semi-continuous casting method is preferably used.

(Heating Process S02)

Next, a heating treatment is performed for homogenization and solutionizing of the obtained ingot. Inside of the ingot, the intermetallic compounds mainly containing Cu and Mg and the like are present which are generated as Mg is condensed as segregation during solidification. Accordingly, in order to eliminate or reduce the segregation, the intermetallic compounds, and the like, a heating treatment of heating the ingot to a temperature of 400° C. or higher and 900° C. or lower is performed such that Mg is homogeneously diffused or Mg is solid-solubilized in the matrix phase inside of the ingot. In addition, the heating process S02 is preferably performed in a non-oxidizing or reducing atmosphere.

Here, when the heating temperature is in a range of less than 400° C., solutionizing is incomplete, and thus there is concern that a large amount of the intermetallic compounds mainly containing Cu and Mg may remain in the matrix phase. In contrast, when the heating temperature is in a range of higher than 900° C., a portion of the copper material becomes a liquid phase, and there is concern that the structure or the surface state thereof may become non-uniform. Therefore, the heating temperature is set to be in a range of 400° C. or higher and 900° C. or lower. The heating temperature is more preferably in a range of 500° C. or higher and 850° C. or lower, and even more preferably in a range of 520° C. or higher and 800° C. or lower.

(Rapid Cooling Process S03)

In addition, the copper material heated to a temperature of 400° C. or higher and 900° C. or lower in the heating process S02 is cooled to a temperature of 200° C. or less at a cooling rate of 200° C./min or higher. By the rapid cooling process S03, Mg solid-solubilized in the matrix phase is suppressed from precipitating as the intermetallic compounds mainly containing Cu and Mg, and during observation by a scanning electron microscope, the average number of intermetallic compounds mainly containing Cu and Mg and having grain sizes of 0.1 μm or greater is preferably in a range of 1 piece/$m^2$ or less. That is, the copper material can be a Cu—Mg solid solution alloy supersaturated with Mg. In the cooling process A03, the lower limit of the cooling temperature is preferably −100° C., and the upper limit of the cooling rate is preferably 10,000° C./min. When the cooling temperature is in a range of lower than −100° C., the effect cannot be enhanced, and the cost is increased. When the cooling rate is in a range of higher than 10,000° C./min, the effect cannot be enhanced, and the cost is also increased.

In addition, for an increase in the efficiency of roughing and the homogenization of the structure, a configuration in which hot working is performed after the above-mentioned heating process S02 and the above-mentioned rapid cooling process S03 is performed after the hot working may be employed. In this case, the working method is not particularly limited. For example, rolling is employed in a case where the final form is a sheet or a strip, drawing, extruding, groove rolling, or the like is employed in a case of a wire or a bar, and forging or press is employed in a case of a bulk shape.

(Intermediate Working Process S04)

The copper material subjected to the heating process S02 and the rapid cooling process S03 is cut as necessary, and surface grinding is performed as necessary in order to remove an oxide film and the like generated in the heating process S02, the rapid cooling process S03, and the like. In addition, the resultant is worked into a predetermined shape.

In addition, the temperature condition in this intermediate working process S04 is not particularly limited, and is preferably in a range of −200° C. to 200° C. for cold working or warm working. In addition, the working ratio is appropriately selected to approximate a final shape, and is preferably in a range of 20% or higher in order to reduce the number of intermediate heat treatment processes S05 to be performed until the final shape is obtained. In addition, the working ratio is more preferably in a range of 30% or higher. The upper limit of the working ratio is not particularly limited, and is preferably 99.9% from the viewpoint of preventing an edge crack. The working method is not particularly limited, and rolling is preferably employed in a case where a final form is a sheet or a strip. It is preferable that extruding or groove rolling be employed in a case where of a wire or a bar and forging or press be employed in a case of a bulk shape. Furthermore, for thorough solutionizing, S02 to S04 may be repeated.

(Intermediate Heat Treatment Process S05)

After the intermediate working process S04, a heat treatment is performed for the purpose of thorough solutionizing and softening to recrystallize the structure or to improve formability.

Here, a heat treatment method is not particularly limited, and the heat treatment is preferably performed in a non-oxidizing atmosphere or a reducing atmosphere under the condition of 400° C. or higher and 900° C. or lower. The heat treatment is performed more preferably at a temperature of 500° C. or higher and 850° C. or lower and even more preferably at a temperature of 520° C. or higher and 800° C. or lower.

Here, in the intermediate heat treatment process S05, the copper material heated at a temperature of 400° C. or higher and 900° C. or lower is cooled to a temperature of 200° C. or lower at a cooling rate of 200° C./min or higher. The cooling temperature of the intermediate heat treatment process S05 is more preferably in a range of 150° C. or lower, and even more preferably in a range of 100° C. or lower. The cooling rate is more preferably in a range of 300° C./min or higher, and even more preferably in a range of 1000° C./min or higher. In contrast, in the intermediate heat treatment process S05, the lower limit of the cooling temperature is preferably −100° C., and the upper limit of the cooling rate is preferably 10,000° C./min. When the cooling temperature is lower than −100° C., the effect cannot be enhanced, and cost is increased. When the cooling rate is in a range of higher than 10,000° C./min, the effect cannot be enhanced, and the cost is also increased.

By the rapid cooling as such, Mg solid-solubilized in the matrix phase is suppressed from precipitating as the intermetallic compounds mainly containing Cu and Mg, and during observation by a scanning electron microscope, the average number of intermetallic compounds mainly containing Cu and Mg and having grain sizes of 0.1 μm or greater can be in a range of 1 piece/$\mu m^2$ or less. That is, the copper material can be a Cu—Mg solid solution alloy supersaturated with Mg.

(Finishing Working Process S06)

Finishing working is performed on the copper material after being subjected to the intermediate heat treatment process S05 so as to have a predetermined shape. In addition, a temperature condition in the finishing working process S06 is not particularly limited, and the finishing working process S06 is preferably performed at room temperature. In addition, the working ratio is appropriately selected to approximate a final shape, and is preferably in a range of 20% or higher in order to increase strength through work hardening. In addition, for a further increase in strength, the working ratio is preferably in a range of 30% or higher. The upper limit of the working ratio is not particularly limited, and is preferably 99.9% from the viewpoint of preventing an edge crack. The working method is not particularly limited, and rolling is preferably employed in a case where the final form is a sheet or a strip. It is preferable that extruding or groove rolling be employed in a case of a wire or a bar and forging or press be employed in a case of a bulk shape.

(Finishing Heat Treatment Process S07)

Next, a finishing heat treatment is performed on the working material obtained in the finishing working process S06 in order to enhance stress relaxation resistance, to perform annealing and hardening at low temperature, or to remove residual strain.

The heat treatment temperature is preferably in a range of higher than 200° and 800° C. or lower. In addition, in the finishing heat treatment process S07, heat treatment conditions (temperature, time, and cooling rate) need to be set so that the solutionized Mg does not precipitate. For example, it is preferable that the conditions be about 10 seconds to 24 hours at 250° C., about 5 seconds to 4 hours at 300° C., and about 0.1 seconds to 60 seconds at 500° C. The finishing heat treatment process S07 is preferably performed in a non-oxidizing atmosphere or a reducing atmosphere.

In addition, a cooling method of cooling the heated copper material to a temperature of 200° C. or lower at a cooling rate of 200° C./min or higher, such as water quenching, is preferable. The cooling temperature is more preferably in a range of 150° C. or lower, and even more preferably in a range of 100° C. or lower. The cooling rate is more preferably in a range of 300° C./min or higher, and even more preferably in a range of 1,000° C./min or higher. In contrast, the lower limit of the cooling temperature is preferably −100° C., and the upper limit of the cooling rate is preferably 10,000° C./min. When the cooling temperature is lower than −100° C., the effect cannot be enhanced, and the cost is increased. When the cooling rate is in a range of higher than 10,000° C./min, the effect cannot be enhanced, and the cost is also increased.

By the rapid cooling as such, Mg solid-solubilized in the matrix phase is suppressed from precipitating as the intermetallic compounds mainly containing Cu and Mg, and during observation by a scanning electron microscope, the average number of intermetallic compounds mainly containing Cu and Mg and having grain sizes of 0.1 μm or greater can be in a range of 1 piece/$\mu m^2$ or less. That is, the copper material can be a Cu—Mg solid solution alloy supersaturated with Mg. Furthermore, the finishing working process S06 and the finishing heat treatment process S07 described above may be repeatedly performed.

In this manner, the copper alloy for electronic devices according to this embodiment is produced. In addition, the copper alloy for electronic devices according to this embodiment has a Young's modulus E of 125 GPa or less and a 0.2% proof stress $\sigma_{0.2}$ of 400 MPa or more. The Young's modulus E of the copper alloy for electronic devices according to this embodiment is more preferably in a range of 100 to 125 GPa, and the 0.2% proof stress $\sigma_{0.2}$ thereof is more preferably in a range of 500 to 900 MPa.

In addition, when the Mg content is given as X at %, the electrical conductivity a (% IACS) is set to be in a range of $\sigma \leq 1.7241/(-0.0347 \times X^2 + 0.6569 \times X + 1.7) \times 100$.

Furthermore, by the finishing heat treatment process S07, the copper alloy for electronic devices according to this embodiment has a stress relaxation rate of 50% or less at 150° C. after 1,000 hours.

According to the copper alloy for electronic devices having the above-described configuration according to this embodiment, Mg is contained in the binary alloy of Cu and Mg at a content of 3.3 at % or more and 6.9 at % or less so as to be equal to or more than a solid solubility limit, and the electrical conductivity a (% IACS) is set to be in a range of $\sigma \leq 1.7241/(-0.0347 \times X^2 + 0.6569 \times X + 1.7) \times 100$ when the Mg content is given as X at %. Furthermore, during the observation by a scanning electron microscope, the average number of intermetallic compounds containing Cu and Mg and having grain sizes of 0.1 μm or greater is in a range of 1 piece/$\mu m^2$ or less.

That is, the copper alloy for electronic devices according to this embodiment is the Cu—Mg solid solution alloy supersaturated with Mg.

The copper alloy made from the Cu—Mg solid solution alloy supersaturated with Mg has tendency to decrease the Young's modulus, and for example, even when the copper alloy is applied to a connector in which a male tab is inserted by pushing up a spring contact portion of a female or the like, a change in contact pressure during the insertion is suppressed, and due to a wide elastic limit, there is no concern for plastic deformation easily occurring. Therefore, the copper alloy is particularly appropriate for a part for electronic devices such as a terminal, a connector, a relay, and a lead frame.

In addition, since the copper alloy is supersaturated with Mg, coarse intermetallic compounds mainly containing Cu and Mg, which are the start points of cracks, are not largely dispersed in the matrix, and bending formability is enhanced. Therefore, a part for electronic devices having a complex shape such as a terminal, a connector, a relay, and a lead frame can be formed.

Moreover, since the copper alloy is supersaturated with Mg, strength is increased through work hardening, and thus a relatively high strength can be achieved.

In addition, since the copper alloy consists of the binary alloy of Cu and Mg containing Cu, Mg, and the unavoidable impurities, a reduction in the electrical conductivity due to other elements is suppressed, and thus a relatively high electrical conductivity can be achieved.

In addition, in the copper alloy for electronic devices according to this embodiment, since the stress relaxation rate at 150° C. after 1,000 hours is in a range of 50% or less, even when the copper alloy is used under a high temperature environment, electrical conduction failure due to a reduction in contact pressure can be suppressed. Therefore, the copper alloy can be applied as the material of a part for electronic devices used under the high temperature environment such as an engine room.

In addition, since the copper alloy for electronic devices has a Young's modulus E of 125 GPa or less and a 0.2% proof stress $\sigma_{0.2}$ of 400 MPa or more, the elastic energy coefficient ($\sigma_{0.2}^2/2E$) is increased, and thus plastic deformation does not easily occur. Therefore, the copper alloy is particularly appropriate for a part for electronic devices such as a terminal, a connector, a relay, and a lead frame.

According to the method for producing the copper alloy for electronic devices according to this embodiment, by the heating process S02 of heating the ingot or the working material consisting of the binary alloy of Cu and Mg and having the above composition to a temperature of 400° C. or higher and 900° C. or lower, the solutionizing of Mg can be achieved.

In addition, since the rapid cooling process S03 of cooling the ingot or the working material heated to a temperature of 400° C. or higher and 900° C. or lower in the heating process S02 to a temperature of 200° C. or less at a cooling rate of 200° C./min or higher is included, the intermetallic compounds mainly containing Cu and Mg can be suppressed from precipitating in the cooling procedure, and thus the ingot or the working material after the rapid cooling can be the Cu—Mg solid solution alloy supersaturated with Mg.

Moreover, since the intermediate working process S04 of working the rapidly-cooled material (the Cu—Mg solid solution alloy supersaturated with Mg) is included, a shape close the final shape can be easily obtained.

In addition, since the intermediate heat treatment process S05 is included for the purpose of thorough solutionizing and the softening to recrystallize the structure or to improve formability after the intermediate working process S04, properties and formability can be improved.

In addition, in the intermediate heat treatment process S05, since the copper material heated to a temperature of 400° C. or higher and 900° C. or lower is cooled to a temperature of 200° C. or less at a cooling rate of 200° C./min or higher, the intermetallic compounds mainly containing Cu and Mg can be suppressed from precipitating in the cooling procedure, and thus the copper material after the rapid cooling can be the Cu—Mg solid solution alloy supersaturated with Mg.

In addition, in the method for producing the copper alloy for electronic devices according to this embodiment, after the finishing working process S06 for increasing strength through work hardening and working the material in a predetermined shape, the finishing heat treatment process S07 of performing the heat treatment is included in order to enhance stress relaxation resistance, to perform annealing and hardening at low temperature, or to remove residual strain. Therefore, the stress relaxation rate at 150° C. after 1,000 hours can be in a range of 50% or less. In addition, a further enhancement of mechanical properties can be achieved.

Here, the stress relaxation rate was measured by applying stress by a method based on a cantilevered screw type of JCBA-T309:2004 of The Japan Copper and Brass Association Technical Standards.

In addition, the copper alloy for electronic devices has a Young's modulus E of 125 GPa or less and a 0.2% proof stress $\sigma_{0.2}$ of 400 MPa or more.

While the copper alloy for electronic devices according to this embodiment of the present invention has been described above, the present invention is not limited thereto and can be appropriately modified in a range that does not depart from the technical features of the invention.

In addition, in this embodiment, the copper alloy for electronic devices which satisfies both the condition that "the number of intermetallic compounds mainly containing Cu and Mg and having grain sizes of 0.1 μm or greater in the alloy is in a range of 1 piece/$\mu m^2$ or less" and the condition of the "electrical conductivity σ" is described. However, a copper alloy for electronic devices which satisfies only one of the conditions may also be employed.

For example, in the above-described embodiment, an example of the method for producing the copper alloy for electronic devices is described. However, the production method is not limited to this embodiment, and the copper alloy may be produced by appropriately selecting existing production methods.

Examples

Hereinafter, results of confirmation tests performed to confirm the effects of the present invention will be described.

A copper raw material consisting of oxygen-free copper (ASTM B152 C10100) having a purity of 99.99 mass % or higher was prepared, the copper material was inserted into a high purity graphite crucible, and subjected to high frequency melting in an atmosphere furnace having an Ar gas atmosphere. Various additional elements were added to the obtained molten copper to prepare component compositions shown in Tables 1 and 2, and the resultant was poured into a carbon mold, thereby producing an ingot. In addition, the dimensions of the ingot were about 20 mm in thickness× about 20 mm in width×about 100 to 120 mm in length.

A heating process of heating the obtained ingot in the Ar gas atmosphere for 4 hours under the temperature conditions shown in Tables 1 and 2 was performed. Thereafter, water quenching was performed thereon (at a cooling temperature of 20° C. and a cooling rate of 1500° C./min).

The ingot after the heat treatment was cut, and surface grinding was performed to remove oxide films.

Thereafter, at the room temperature, intermediate rolling was performed at a rolling ratio shown in Tables 1 and 2. In addition, an intermediate heat treatment was performed on the obtained strip material in a salt bath under the temperature conditions shown in Tables 1 and 2. Thereafter, water quenching was performed (at a cooling temperature of 20° C. and a cooling rate of 1500° C./min).

Subsequently, finish rolling was performed at a rolling ratio shown in Tables 1 and 2, thereby producing a strip material having a thickness of 0.25 mm and a width of about 20 min.

In addition, after the finish rolling, a finishing heat treatment was performed in a salt bath under the conditions shown in Tables. Thereafter, water quenching was performed on the resultant (at a cooling temperature of 20° C. and a cooling rate of 1500° C./min), thereby producing a strip material for property evaluation.

(Grain Size after Intermediate Heat Treatment)

The grain size of the sample after being subjected to the intermediate heat treatment shown in Tables 1 and 2 was measured. Mirror polishing and etching were performed on each sample, the sample was photographed by an optical microscope so that the rolling direction thereof was the horizontal direction of the photograph, and the observation was performed in a visual field at 1,000-fold magnification (about 300 μm×200 μm). Subsequently, regarding the grain size, according to an intercept method of JIS H 0501, 5 segments having vertically and horizontally predetermined lengths were drawn in the photograph, the number of crystal grains which were completely cut was counted, and the average value of the cut lengths thereof was determined as the grain size.

(Formability Evaluation)

As formability evaluation, presence or absence of an edge crack occurred during the cold rolling was observed. The samples in which no or substantially no edge cracks were visually confirmed were evaluated as A, the samples in which small edge cracks having a length of less than 1 mm had occurred were evaluated as B, the samples in which edge cracks having a length of 1 min or greater and less than 3 mm had occurred were evaluated as C, the samples in which large edge cracks having a length of 3 mm or greater had occurred were evaluated as D, and the samples which were fractured during the rolling due to edge cracks were evaluated as E.

In addition, the length of the edge crack is the length of an edge crack directed from an end portion of a rolled material in a width direction to a center portion in the width direction.

In addition, using the strip material for property evaluation described above, mechanical properties and electrical conductivity were measured.

(Mechanical Properties)

A No. 13B specimen specified in JIS Z 2201 was collected from the strip material for property evaluation, and the 0.2% proof stress $\sigma_{0.2}$ thereof was measured by an offset method in JIS Z 2241. In addition, the specimen was collected from the strip material for property evaluation in a direction parallel to the rolling direction.

The Young's modulus E was obtained from the gradient of a load-elongation curve by applying a strain gauge to the specimen described above.

In addition, the specimen was collected so that a tensile direction of a tensile test was parallel to the rolling direction of the strip material for property evaluation.

(Electrical Conductivity)

A specimen having a size of 10 mm in width×60 mm in length was collected from the strip material for property evaluation, and the electrical resistance thereof was obtained by a four terminal method. In addition, the dimensions of the specimen were measured using a micrometer, and the volume of the specimen was calculated. In addition, the electrical conductivity thereof was calculated from the measured electrical resistance and the volume. In addition the specimen was collected so that the longitudinal direction thereof was parallel to the rolling direction of the strip material for property evaluation.

(Stress Relaxation Resistance)

In a stress relaxation resistance test, stress was applied by the method based on a cantilevered screw type of JCBA-T309:2004 of The Japan Copper and Brass Association Technical Standards, and a residual stress ratio after being held at 150° C. for a predetermined time was measured.

The measurement was performed using a stress relaxation measuring device KL-30, LK-GD500, or KZ-U3) manufactured by Keyence Corporation.

Specifically, first, using a test jig for a deflection displacement load in the cantilevered screw type, one end of a specimen in the longitudinal direction was fixed (fixed end).

The specimen (10 mm in width×60 mm in length) was collected from the strip material for property evaluation so that the longitudinal direction thereof was parallel to the rolling direction of the strip material for property evaluation.

Subsequently, a free end (the other end) of the specimen in the longitudinal direction was allowed to come into contact with a tip end of a bolt for a deflection displacement load in the vertical direction, and a load was applied to the free end of the specimen in the longitudinal direction.

At this time, an initial deflection displacement was set to be 2 mm so as to allow the surface maximum stress of the specimen to be 80% of the proof stress, thereby adjusting a span length. Span length is the distance from the fixed end of a specimen to the portion that comes into contact with the tip end of the bolt in the direction perpendicular to the load direction of the bolt for a deflection displacement load, when an initial deflection was imparted to the specimen. The surface maximum stress is determined by the following expression.

$$\text{Surface maximum stress (MPa)}=1.5Et\delta_0/L_s^2$$

where

E: the deflection coefficient (MPa), t: the thickness of the sample (t=0.25 mm), $\delta_0$: the initial deflection displacement (2 mm), and $L_s$: the span length (mm).

The specimen of which the initial deflection displacement was set to be 2 mm was held in a thermostatic chamber at a temperature of 150° C. for 1,000 hours. Thereafter, the specimen with the test jig for a deflection displacement load in the cantilevered screw type was taken out to room temperature, and the bolt for a deflection displacement load was loosened to remove the load.

From the bending behavior of the specimen which was cooled to the room temperature and remained after being held at a temperature of 150° C. for 1,000 hours, the residual stress ratio (difference in permanent deflection displacement) was measured, and the stress relaxation rate was evaluated. In addition, the stress relaxation rate was calculated using the following expression.

$$\text{Stress relaxation rate (\%)}=(\delta_t/\delta_0)\times 100$$

where $\delta_t$: the permanent deflection displacement (mm) after being held at 150° C. for 1,000 hours−the permanent deflection displacement (mm) after being held at room temperature for 24 hours, and $\delta_0$: the initial deflection displacement (mm).

(Structure Observation)

Mirror polishing and ion etching were performed on the rolled surface of each sample. In order to check the precipitation state of the intermetallic compounds mainly containing Cu and Mg, observation was performed in a visual field at a 10,000-fold magnification (about 120 $\mu m^2$/visual field) using an FE-SEM (field emission type scanning electron microscope).

Subsequently, in order to examine the density (piece/$\mu m^2$) of the intermetallic compounds mainly containing Cu and Mg, a visual field at a 10,000-fold magnification (about 120 $\mu m^2$/visual field) in which the precipitation state of the intermetallic compounds was not unusual was selected, and in the region, 10 continuous visual fields (about 4.8 $\mu m^2$/visual field) were photographed at a 50,000-fold magnification. The grain size of the intermetallic compound was obtained from the average value of a major axis of the intermetallic compound (the length of the longest intragranular straight line which is drawn under a condition without intergranular contact on the way) and a minor axis (the length of the longest straight line which is drawn under a condition without intergranular contact on the way in a direction perpendicular to the major axis). In addition, the density (piece/$\mu m^2$) of the intermetallic compounds mainly containing Cu and Mg and having grain sizes of 0.1 μm or greater was obtained.

(Bending Formability)

Bending based on the test method of JCBA-T307:2007-4 of The Japan Copper and Brass Association Technical Standards was performed.

A plurality of specimens having a size of 10 mm in width×30 mm in length were collected from the strip material for property evaluation so that the rolling direction and the longitudinal direction of the specimen were parallel to each other, a W bending test was performed using a W-shaped jig having a bending angle of 90 degrees and a bending radius of 0.25 mm.

In addition, the outer peripheral portion of a bent portion was visually checked, and a case where a fractures had occurred was evaluated as D, a case where only a partial fracture had occurred was evaluated as C, a case where only a fine crack had occurred without fracturing was evaluated as B, and a case where no facture or fine crack could be confirmed was evaluated as A.

The conditions and the evaluation results are shown in Tables 1 to 4.

TABLE 1

| | | Mg (at %) | — | Temperature of heating process | Rolling ratio of intermediate rolling | Temperature of intermediate heat treatment | Rolling ratio of finish rolling | Finishing heat treatment Temperature | Finishing heat treatment Time |
|---|---|---|---|---|---|---|---|---|---|
| Invention Examples | 1 | 3.4 | — | 715° C. | 70% | 625° C. | 60% | 250° C. | 60 min |
| | 2 | 4.1 | — | 715° C. | 70% | 625° C. | 60% | 280° C. | 30 min |
| | 3 | 4.4 | — | 715° C. | 70% | 625° C. | 60% | 300° C. | 1 min |
| | 4 | 5.0 | — | 715° C. | 70% | 625° C. | 60% | 330° C. | 1 min |
| | 5 | 5.4 | — | 715° C. | 70% | 625° C. | 60% | 350° C. | 30 sec |
| | 6 | 5.9 | — | 715° C. | 70% | 700° C. | 60% | 320° C. | 1 min |
| | 7 | 6.4 | — | 715° C. | 70% | 700° C. | 60% | 280° C. | 5 min |
| | 8 | 4.4 | — | 715° C. | 70% | 625° C. | 70% | 200° C. | 24 h |
| | 9 | 4.3 | — | 715° C. | 70% | 625° C. | 70% | 350° C. | 1 min |
| | 10 | 4.6 | — | 715° C. | 70% | 625° C. | 70% | 500° C. | 1 sec |
| | 11 | 5.8 | — | 715° C. | 70% | 675° C. | 60% | 300° C. | 5 min |
| | 12 | 5.8 | — | 715° C. | 70% | 650° C. | 60% | 300° C. | 2 min |
| | 13 | 4.2 | — | 715° C. | 70% | 625° C. | 60% | 230° C. | 1 sec |
| | 14 | 4.2 | — | 715° C. | 70% | 625° C. | 60% | 230° C. | 60 sec |

TABLE 2

| | | Mg (at %) | — | Temperature of heating process | Rolling ratio of intermediate rolling | Temperature of intermediate heat treatment | Rolling ratio of finishing working | Finishing heat treatment Temperature | Finishing heat treatment Time |
|---|---|---|---|---|---|---|---|---|---|
| Comparative Examples | 1 | 0.9 | — | 715° C. | 70% | 600° C. | 70% | 300° C. | 1 min |
| | 2 | 7.8 | — | 715° C. | 70% | — | — | — | — |
| | 3 | 10.2 | — | 715° C. | 70% | — | — | — | — |
| | 4 | 4.4 | — | 715° C. | 70% | 625° C. | 70% | — | — |
| | 5 | 4.6 | — | 715° C. | 70% | 625° C. | 70% | 400° C. | 1 h |

| | | Sn (at %) | P (at %) | Temperature of heating process | Rolling ratio of intermediate rolling | Temperature of intermediate heat treatment | Rolling ratio of finishing working | Finishing heat treatment Temperature | Finishing heat treatment Time |
|---|---|---|---|---|---|---|---|---|---|
| Conventional Examples | 1 | 3.3 | 0.3 | 800° C. | 70% | 500° C. | 70% | 250° C. | 1 min |
| | 2 | 4.4 | 0.3 | 800° C. | 70% | 500° C. | 70% | 250° C. | 1 min |

TABLE 3

| | | Grain size after intermediate heat treatment (μm) | Edge crack | Electrical conductivity % IACS | Upper limit of electrical conductivity | Precipitates (pieces/μm$^2$) | 0.2% proof stress MPa | Stress relaxation rate | Young's modulus GPa | Bending formability |
|---|---|---|---|---|---|---|---|---|---|---|
| Invention Examples | 1 | 15 | A | 44.1% | 48.8% | 0 | 530 | 19% | 115 | A |
| | 2 | 14 | A | 40.9% | 45.3% | 0 | 574 | 18% | 112 | A |
| | 3 | 16 | A | 38.0% | 44.0% | 0 | 605 | 20% | 111 | A |
| | 4 | 15 | A | 34.8% | 41.9% | 0 | 618 | 17% | 110 | A |
| | 5 | 15 | A | 32.8% | 40.7% | 0 | 640 | 18% | 110 | A |
| | 6 | 45 | B | 33.0% | 39.5% | 0 | 638 | 20% | 108 | A |
| | 7 | 51 | B | 31.2% | 38.5% | 0 | 661 | 20% | 106 | A |
| | 8 | 15 | A | 38.1% | 44.0% | 0 | 640 | 28% | 111 | A |
| | 9 | 14 | A | 39.1% | 44.4% | 0 | 615 | 15% | 111 | A |
| | 10 | 14 | A | 39.2% | 43.2% | 0 | 622 | 17% | 112 | A |
| | 11 | 33 | B | 37.2% | 39.7% | 0 | 642 | 22% | 109 | B |
| | 12 | 25 | B | 38.2% | 39.7% | 0 | 650 | 23% | 108 | B |
| | 13 | 15 | A | 40.3% | 44.8% | 0 | 595 | 47% | 112 | A |
| | 14 | 13 | A | 40.0% | 44.8% | 0 | 590 | 39% | 111 | A |

TABLE 4

| | | Grain size after intermediate heat treatment (μm) | Edge crack | Electrical conductivity % IACS | Upper limit of electrical conductivity | Precipitate (pieces/μm$^2$) | 0.2% proof stress MPa | Stress relaxation rate | Young's modulus GPa | Bending formability |
|---|---|---|---|---|---|---|---|---|---|---|
| Comparative Examples | 1 | 10 | A | 72.8% | 76.2% | 0 | 430 | 21% | 127 | A |
| | 2 | — | E | — | — | — | — | — | — | — |
| | 3 | — | E | — | — | — | — | — | — | — |
| | 4 | 11 | A | 38.0% | 44.0% | 0 | 660 | 54% | 111 | A |
| | 5 | 14 | A | 47.9% | 43.2% | 10 | 380 | 19% | 117 | D |
| Conventional Examples | 1 | 10 | B | 14.0% | — | — | 684 | 55% | 110 | A |
| | 2 | 8 | B | 12.9% | — | — | 754 | 53% | 109 | A |

In Comparative Example 1 in which the Mg content was lower than the range of the present invention, the Young's modulus was high and insufficient.

In addition, in Comparative Examples 2 and 3 in which the Mg contents were more than the range of the present invention, large edge cracks had occurred during cold rolling, and thus the subsequent property evaluation could not be performed.

In addition, in Comparative Example 4 in which the Mg content was in the range of the present invention but the finishing heat treatment after the finish rolling was not performed, the stress relaxation rate was 54%.

Moreover, in Comparative Example 5 in which the Mg content was in the range of the present invention but the electrical conductivity and the number of intermetallic compounds mainly containing Cu and Mg were out of the ranges of the present invention, deterioration in proof stress and bending formability was confirmed.

Furthermore, in Conventional Examples 1 and 2 including copper alloys containing Sn and P, so-called phosphor bronze, the electrical conductivity was low, and the stress relaxation rate was more than 50%.

Contrary to this, in all Invention Examples 1 to 14, the Young's modulus was in a range of 125 GPa or less and was thus set to be low, and the 0.2% proof stress was also in a range of 400 MPa or more, resulting in excellent elasticity. In addition, the stress relaxation rate was in a range of 47% or less and was thus low.

As described above, according to the Invention Examples, it was confirmed that a copper alloy for electronic devices which has low Young's modulus, high proof stress, high electrical conductivity, excellent stress relaxation resistance, and excellent bending formability and is appropriate for a part for electronic devices such as a terminal, a connector, or a relay can be provided.

The invention claimed is:

1. A rolled copper alloy material for electronic devices, consisting of:

a binary alloy of Cu and Mg, wherein the binary alloy is a Cu—Mg solid solution alloy supersaturated with Mg, the binary alloy consists of Mg at a content of 3.3 at % or more and 6.9 at % or less, and a remainder of Cu and unavoidable impurities, an amount of Zn as an unavoidable impurity is less than 0.01 mass %, a total amount of the unavoidable impurities is in a range of 0.3 mass % or less, the rolled copper alloy material is a sheet or a strip, the binary alloy has a measured value of electrical conductivity, σ, in a range of 31.2-44.1% IACS, wherein the measured value of electrical conductivity is less than or equal to an upper limit of electrical conductivity, in %, calculated by the formulaic expression, $\{1.7241/(-0.0347\times X^2+0.6569\times X+1.7)\}\times 100$, wherein X is the content of the Mg in the binary alloy;

a stress relaxation rate is in a range of 50% or less after heating at 150° C. for 1,000 hours, and a 0.2% proof stress $\sigma_{0.2}$ in a direction parallel to a rolling direction is in a range of 400 MPa or more.

2. The rolled copper alloy material for electronic devices according to claim 1, wherein an average number of intermetallic compounds mainly containing Cu and Mg and having grain sizes of 0.1 μm or greater is in a range of 1 piece/μm$^2$ or less during observation by a scanning electron microscope.

3. The rolled copper alloy material for electronic devices according to claim 1, wherein a Young's modulus E in a direction parallel to a rolling direction is in a range of 125 GPa or less.

4. The rolled copper alloy material for electronic devices according to claim 1, wherein the rolled copper alloy material is used as a copper material included in a part for a terminal, a connector, a relay, or a lead frame.

5. A part for electronic devices, comprising the rolled copper alloy material according to claim 1.

6. The rolled copper alloy material for electronic devices according to claim 2, wherein a Young's modulus E in a direction parallel to a rolling direction is in a range of 125 GPa or less.

7. The rolled copper alloy material for electronic devices according to claim 2, wherein the rolled copper alloy material is used as a copper material included in a part for a terminal, a connector, a relay, or a lead frame.

8. A part for electronic devices, comprising the rolled copper alloy material according to claim 2.

9. A method for producing a rolled copper alloy material for electronic devices, the method comprising:

a heating process of heating an ingot consisting of a binary alloy of Cu and Mg at a temperature of 400 to 900° C. to obtain a copper material;

a first rapid cooling process of cooling the copper material;

an intermediate heat treatment process of heating the copper material;

a second rapid cooling process of cooling the copper material;

a finishing working process of subjecting the copper material to rolling into a predetermined shape;

a finishing heat treatment process of subjecting the copper material to a heat treatment after the finishing working process; and a third rapid cooling process of cooling the copper material, wherein in the first, second and third rapid cooling processes, the copper material is cooled to a temperature of 200° C. or lower at a cooling rate of 200° C./min or higher, wherein the produced rolled copper alloy material consists of the binary alloy of Cu and Mg, the rolled alloy material is a solution alloy supersaturated with Mg, the binary alloy consists of Mg at a content of 3.3 at % or more and 6.9 at % or less, and a remainder of Cu and unavoidable impurities, an amount of Zn as an unavoidable impurity is less than 0.01 mass %, a total amount of the unavoidable impurities is in a range of 0.3 mass % or less, the rolled copper alloy material is a sheet or a strip, the binary alloy has a measured value of electrical conductivity, σ, in a range of 31.2-44.1% IACS, wherein the measured value of electrical conductivity is less than or equal to an upper limit of electrical conductivity, in %, calculated by the formulaic expression, $\{1.7241/(-0.0347\times X^2+0.6569\times X+1.7)\}\times 100$, wherein X is the content of the Mg in the binary alloy;

a stress relaxation rate of the rolled copper alloy material is in a range of 50% or less after heating at 150° C. for 1,000 hours, and a 0.2% proof stress $\sigma_{0.2}$ of the rolled copper alloy material in a direction parallel to a rolling direction is in a range of 400 MPa or more.

10. The method for producing a rolled copper alloy material for electronic devices according to claim 9, wherein, in the intermediate heat treatment process, the heat treatment is performed at a temperature of 400° C. or higher and 900° C. or lower, and in the finishing heat treatment process, the heat treatment is performed at a temperature of higher than 200° C. and 800° C. or lower.

11. A method for producing a rolled copper alloy material for electronic devices, the method comprising:

a heating process of heating an ingot consisting of a binary alloy of Cu and Mg at a temperature of 400 to 900° C. to obtain a copper material;

a first rapid cooling process of cooling the copper material;

an intermediate heat treatment process of heating the copper material;

a second rapid cooling process of cooling the copper material;

a finishing working process of subjecting the copper material to rolling into a predetermined shape;

a finishing heat treatment process of subjecting the copper material to a heat treatment after the finishing working process; and a third rapid cooling process of the cooling copper material, wherein in the first, second and third rapid cooling processes, the copper material is cooled to a temperature of 200° C. or lower at a cooling rate of 200° C./min or higher, wherein the produced rolled copper alloy material consists of the binary alloy of Cu and Mg, the rolled copper alloy material is a Cu—Mg solid solution alloy supersaturated with Mg, the binary alloy consists of Mg at a content of 3.3 at % or more and 6.9 at % or less, and a remainder of Cu and unavoidable impurities, an amount of Zn as an unavoidable impurity is less than 0.01 mass %, a total amount of the unavoidable impurities is in a range of 0.3 mass % or less, the rolled copper alloy material is a sheet or a strip, the binary alloy has a measured value of electrical conductivity, σ, in a range of 31.2-44.1% IACS, wherein the measured value of electrical conductivity is less than or equal to an upper limit of electrical conductivity, in %, calculated by the formulaic expression, $\{1.7241/(-0.0347\times X^2+0.6569\times X+1.7)\}\times 100$, wherein X is the content of the Mg in the binary alloy;

a stress relaxation rate of the rolled copper alloy material is in a range of 50% or less after heating at 150° C. for 1,000 hours, a 0.2% proof stress $\sigma_{0.2}$ of the rolled copper alloy material in a direction parallel to a rolling direction is in a range of 400 MPa or more, and an average number of intermetallic compounds mainly containing Cu and Mg and having grain sizes of 0.1 μm or greater in the rolled copper alloy material is in a range of 1 piece/$\mu m^2$ or less during observation by a scanning electron microscope.

12. The method for producing a rolled copper alloy material for electronic devices according to claim 11, wherein in the intermediate heat treatment process, the heat treatment is performed at a temperature of 400° C. or higher and 900° C. or lower, and in the finishing heat treatment process, the heat treatment is performed at a temperature of higher than 200° C. and 800° C. or lower.

* * * * *